US005410961A

United States Patent [19]

DeNicola et al.

[11] Patent Number: 5,410,961

[45] Date of Patent: May 2, 1995

[54] FOUNTAIN ASSEMBLY

[75] Inventors: Christian DeNicola, Hampton; Alesandro Martino, Roselle Park, both of N.J.

[73] Assignee: FIT Group, Inc., Quakertown, Pa.

[21] Appl. No.: 998,732

[22] Filed: Dec. 30, 1992

[51] Int. Cl.[6] ..... B41F 31/04; B41F 31/06; B41F 31/08

[52] U.S. Cl. ..... 101/363; 101/366

[58] Field of Search ..... 101/366, 365, 350, 363, 101/207–210, 148, 157, 169; 118/259, 261, 407, 410, 413; 427/356

[56] References Cited

U.S. PATENT DOCUMENTS

| | | | |
|---|---|---|---|
| 3,057,327 | 10/1962 | Faeber et al. | 101/207 X |
| 3,135,197 | 6/1964 | Dutro et al. | 101/364 |
| 3,186,339 | 6/1965 | Turner et al. | 101/365 |
| 4,026,210 | 5/1977 | Merzagora | 101/350 |
| 4,162,501 | 7/1979 | Mitchell et al. | 101/366 |
| 4,461,211 | 7/1984 | Wesselmann et al. | 101/366 |
| 4,463,675 | 8/1984 | Ottenhues | 101/157 |
| 4,590,855 | 5/1986 | Schommer et al. | 101/157 |
| 4,789,432 | 12/1988 | Goodnow et al. | 162/281 |
| 4,796,528 | 1/1989 | Sarazen | 101/208 |
| 4,821,672 | 4/1989 | Bruno | 118/261 |
| 4,906,335 | 3/1990 | Goodnow et al. | 162/281 |
| 5,003,876 | 4/1991 | Harrison et al. | 101/350 |
| 5,003,877 | 4/1991 | Yano et al. | 101/363 |
| 5,010,819 | 4/1991 | Uribe et al. | 101/425 |
| 5,027,513 | 6/1991 | Allison, Jr. | 30/169 |
| 5,038,681 | 8/1991 | Huitberg et al. | 101/148 |
| 5,040,456 | 8/1991 | Hayes | 101/127.1 |
| 5,040,457 | 8/1991 | Lin | 101/147 |
| 5,058,502 | 10/1991 | Kobler et al. | 101/363 |
| 5,085,144 | 2/1992 | Lindstrom et al. | 101/363 |
| 5,125,341 | 6/1992 | Yaeso | 101/367 |
| 5,150,651 | 9/1992 | Flores | 101/207 |

*Primary Examiner*—J. Reed Fisher
*Attorney, Agent, or Firm*—Richard S. Roberts

[57] ABSTRACT

A fountain assembly for applying a fluid composition uniformly to the circumferential surface of a rotating transfer roller. The assembly has an elongated plastic frame having a concave channel formed on one side of it and a rigid metal brace on the other side. A pair of doctor blades is attached to opposite sides of said channel and positioned to contact the surface of the transfer roller. A pair of curved radial surface seals form a resilient bulkhead with the ends of said doctor blades to form a seal with the roller. The radial surface seals, doctor blades and concave channel form a closed chamber when positioned against the transfer roller. A pivot supports the fountain assembly, alternately swiveling said fountain assembly toward and away from the transfer roller. Means are provided for supplying a fluid composition into the channel. In one embodiment, air cylinders are mounted between the pivoting support and frame for adjusting the position of said fountain assembly by thrusting the frame into and out of contact with the transfer roller. In another embodiment, washing nozzles are disposed along the channel for spraying a washing solution to the channel via an internal manifold within the frame for directing a washing fluid to the nozzles and dispensing a controlled amount of a washing solution under pressure through the manifold and nozzles.

25 Claims, 10 Drawing Sheets

FOUNTAIN ASSEMBLY

BACKGROUND OF THE INVENTION

The present invention relates to a fountain assembly for applying a fluid composition such as ink, uniformly to the circumferential surface of a rotating transfer roller, for example, in a flexographic printing apparatus.

It is well known in the art to apply a liquid substance to a moving web of material. In particular, in the art of printing, ink must be moved from a storage reservoir to a series of ink transfer rollers by means of an ink fountain. In the technique of flexographic printing, it is known to apply colored inks to a web of a moving substrate, such as paper, with a rotating transfer or anilox roller, and to directly apply the ink uniformly and in a metered amount onto such a roller by means of an ink fountain assembly. From the roller, the ink is transferred to a plate cylinder and then to the material to be printed. Fountain assemblies generally include a channel extending the length of the transfer roller and in contact with the circumferential surface of it. A regulated amount of ink is continuously supplied to the fountain and then from the fountain to the roller with excess ink being returned from the fountain to an ink storage reservoir. A pair of doctor blades extend longitudinally on either side of the channel. The doctor blades are angled toward the transfer roller surface and serve both to seal the channel to the roller and to form an uniform film of the coating liquid on the roller transfer surface. As the roller rotates with respect to the fountain, microscopic cells engraved on the roller fill with ink. The doctor blades scrape excess ink from the roller and leave a uniform film of ink across the roller. The blades acts as an ink seal between the fountain body and the roller. The assembly also has some means to seal the channel at its ends so that the ink does not escape from the sides of the fountain assembly. This type of coating system is particularly used in flexographic and gravure printing, and coating applicators in a variety of industrial processes.

Fountain assemblies in and of themselves are known in the art. U.S. Pat. Nos. 4,026,210 and 5,027,513 disclose a printing apparatus having a doctor blade made from steel and teflon polymer. U.S. Pat. Nos. 4,821,672; 5,125,341 and 4,590,855 disclose the various types of end seals useful in fountain assemblies. U.S. Pat. No. 5,003,877 discloses an inker having dams that confine ink to a specific area of the rollers and water is used as a lubricating fluid. U.S. Pat. No. 3,186,339 shows an apparatus where fluid under pressure is used to move a number of plungers which cause a doctor blade to be pressed against a roller. U.S. Pat. No. 4,463,675 shows an apparatus which uses fluid pressure applied to a number of cylinders to press a blade against a roller. U.S. Pat. Nos. 4,906,335 and 4,789,432 teach fluid pressure application means that is actuated to press a blade against a roller and liquid filled tubes are used to effect angular adjustment. U.S. Pat. No. 4,461,211 shows fluid pressure means to press an inking assembly including blades against a roller. U.S. Pat. No. 5,003,877 discloses a pumped ink supply and a water wash that cleans the inker. Wash fluid is conducted through the ink supply lines rather than through nozzles in the doctor blade assembly. U.S. Pat. Nos. 5,085,144 and 5,058,502 show supplying ink to fountains. U.S. Pat. No. 5,040,457 discloses spray nozzle assemblies with press dampeners for use during offset printing, but which are not used to clean fountain assemblies. U.S. Pat. No. 4,796,528 shows an ink fountain with zone separators to permit use of different inks simultaneously.

An important factor for effective doctoring is to maintain doctor blade control. That is to keep the blades at a uniform blade angle and pressure along their entire length at a contact line with the rotating transfer cylinder. If the blade angle is incorrect, wiping action, and thus printing will be poor. Excessive blade loading pressure will also accelerate wear of both the blade and the roller surface and increase friction which will cause premature roller wear. One reason for difficulty with doctor blade control is that the fountain assembly has considerable mass since it is manufactured from a block of metal, usually cast aluminum with an electroless nickel coating for corrosion resistance. In one aspect of the present invention, this problem is solved by producing a fountain assembly which is composed of light weight, polymeric, plastic materials which are much easier to control than solid metal assemblies. The weight of the fountain of the present invention typically has only one-third of the weight of prior art fountains. However, lightness of weight of assembly material has the disadvantage of loss of rigidity of the blade assembly. This produces a deflection of the fountain thus causing the blades to have a tendency to be uneven across the length of the roller surface. This flexibility problem is solved without sacrificing lightness of weight by providing a fountain with a rigid metal backbone. An important additional feature of the invention is that the fountain assembly can be adjusted by hand without the use of separate tools. Prior art fountains are complex to adjust, and hence industrial establishments are induced to have spare fountains on hand for substitution onto coating machines. In effect, the spare fountains are adjusted off the coating machine and then subsequently attached to the coater. This substitution causes excessive down time as well as a high cost in extra fountains. Additionally, loose tools are easily lost. In contrast, the tool-less fountain of this invention is adjustable by hand without separate tools. This allows quick make-ready of the fountain by simple adjustment while it is still attached to the coating machine. Production time loss is thus minimized. The resulting fountain assembly is light weight, rigid, corrosion resistant, and easily cleaned and maintained without the use of tools. The invention provides an improved fountain assembly whose additional improved features are discussed hereinafter.

SUMMARY OF THE INVENTION

Figure 1:
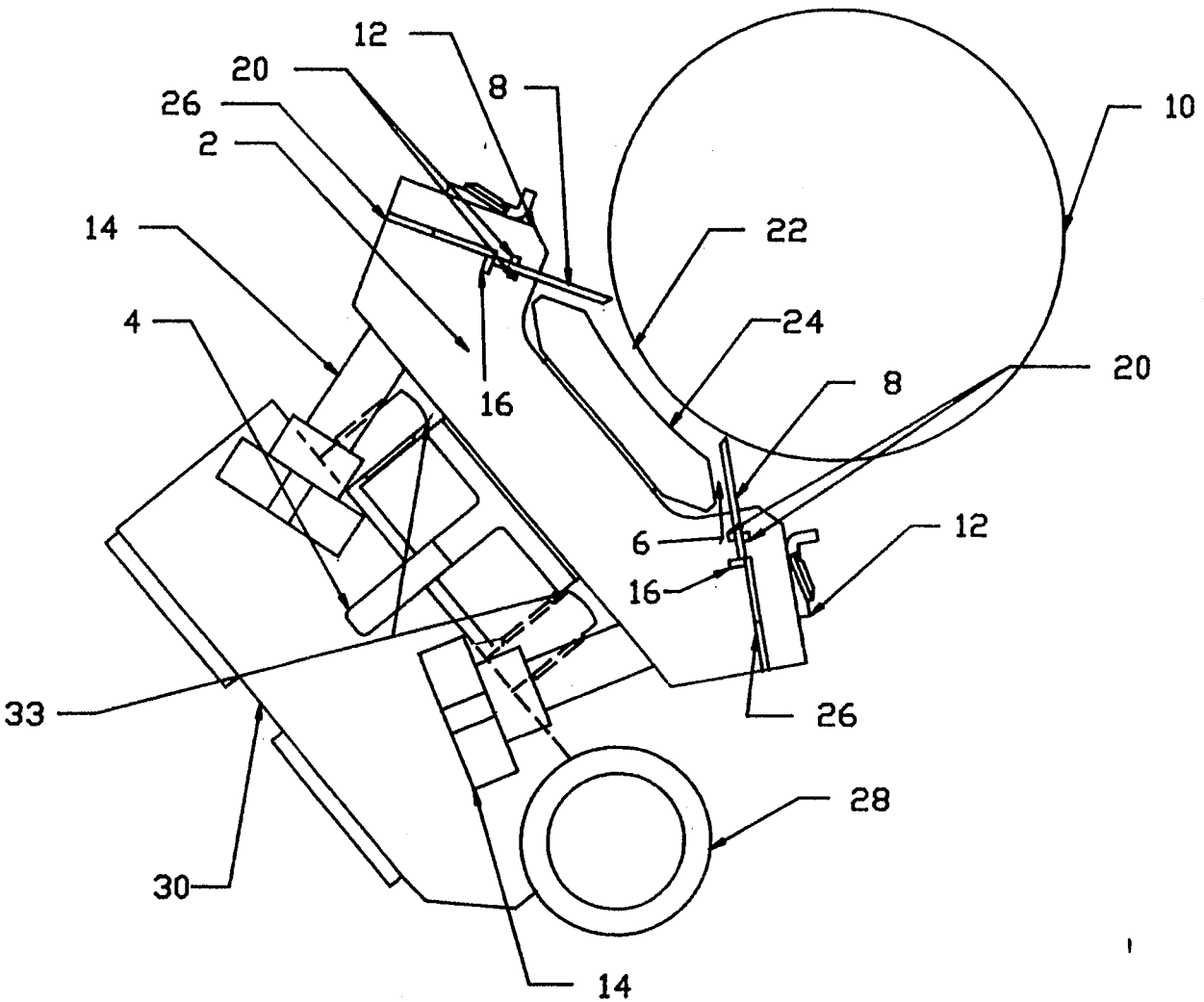
FIG. 1 is a side elevational view of the fountain assembly of the invention and shows its use with an anilox roller.

The invention provides a fountain assembly for applying a fluid composition uniformly to the circumferential surface of a rotating transfer roller comprising an elongated frame having a concave channel formed on one side of the frame along the length thereof, the frame comprising a substantially inert, resilient, light weight, polymeric plastic material. There is a rigid, reinforcing brace fixed along substantially the entire length of said frame on an outer side thereof opposite the channel. A pair of doctor blades are removably attached by clamping means on opposite sides of said channel and extend the length of the channel, the blades being positionable to contact the circumferential surface of the transfer roller. A pair of radial surface seals are secured to the fountain assembly at opposite ends of the cavity, the radial surface seals being positioned to form a resilient bulkhead with the ends of the doctor blades. The radial surface seals have a complementary curved edge for forming a sealing engagement with the circumferential surface of the transfer roller. The radial surface seals, doctor blades and concave channel form a closed chamber when positioned against the transfer roller. A pivoting support, bearing the fountain assembly is provided wherein the support is capable of alternately swiveling the fountain assembly toward and away from the transfer roller. Means are then present for providing a supply of a fluid composition into the channel.

The invention also provides a fountain assembly for applying a fluid composition uniformly to the circumferential surface of a rotating transfer roller comprising an elongated frame having a concave channel formed on one side of said frame along the length thereof and a pair of doctor blades removably attached by clamping means on opposite sides of said channel and extending the length of said channel. The blades are positionable to contact the circumferential surface of the transfer roller. A pair of radial surface seals are secured to the fountain assembly at opposite ends of said cavity wherein the radial surface seals are positioned to form a resilient bulkhead with the ends of the doctor blades. The radial surface seals have a complementary curved edge for forming a sealing engagement with the circumferential surface of the transfer roller. The radial surface seals, doctor blades and concave channel form a closed chamber when positioned against the transfer roller. Pivoting support means bear the fountain assembly and the support is capable of alternately swiveling the frame toward and away from the transfer roller. Air cylinder means are mounted between the pivoting support and the frame wherein the air cylinder means are capable of adjusting the position of the frame by thrusting the frame into and out of contact with the transfer roller. Means are present for providing a supply of a fluid composition into the channel.

The invention further provides a fountain assembly for applying a fluid composition uniformly to the circumferential surface of a rotating transfer roller comprising an elongated frame having a concave channel formed on one side of the frame along the length thereof and a pair of doctor blades removably attached by clamping means on opposite sides of the channel and extending the length of the channel. The blades are positionable to contact the circumferential surface of the transfer roller. A pair of radial surface seals are secured to the fountain assembly at opposite ends of the cavity wherein the radial surface seals are positioned to form a resilient bulkhead with the ends of the doctor blades. The radial surface seals have a complementary curved edge for forming a sealing engagement with the circumferential surface of the transfer roller. The radial surface seals, doctor blades and concave channel form a closed chamber when positioned against the transfer roller. A plurality of washing nozzles is disposed along the channel which are capable of spraying a washing solution to the channel. Internal manifold means are within the frame for directing a washing fluid to the nozzles together with means for dispensing a controlled amount of a washing solution under pressure through the manifold and the nozzles. Pivoting support means bearing the fountain assembly is provided and is capable of alternately swiveling the fountain assembly toward and away from the transfer roller. Means are present for providing a supply of a fluid composition into the channel.

The invention still further comprises a fountain assembly for applying a fluid composition uniformly to the circumferential surface of a rotating transfer roller. It has an elongated frame having a concave channel formed on one side of said frame along the length thereof and a pair of doctor blades removably attached by clamping means on opposite sides of the channel and extending the length of said channel, the blades being positionable to contact the circumferential surface of the transfer roller. A pair of radial surface seals are secured to the fountain assembly at opposite ends of the cavity, the radial surface seals being positioned to form a resilient bulkhead with the ends of the doctor blades and the radial surface seals have a complementary curved edge for forming a sealing engagement with the circumferential surface of the transfer roller. The said radial surface seals, doctor blades and concave channel form a closed chamber when positioned against the transfer roller. Pivoting support means bear the frame, the support means being capable of alternately swiveling the frame toward and away from the transfer roller. The assembly has means for providing a supply of a fluid composition into the channel. The assembly also has lubrication supply means comprising a manifold internal to the frame for directing lubricating fluid to the radial surface seals; and means for supplying a lubricating fluid to the manifold in an amount sufficient to maintain the radial surface seals moist with lubricating fluid.

The invention still further provides a radial surface seal for the fountain assembly comprising a layer of an absorbent material and a layer of a closed cell, non-absorbing foam polymer on each opposite side of the absorbent material to define a composite. The composite has an outer edge contour which when positioned in the fountain assembly is capable of forming a resilient sealing engagement with the ends of the pair of doctor blades, the frame and the circumferential surface of a transfer roller.

DETAILED DESCRIPTION OF THE PREFERRED EMBODIMENT

Figure 3:
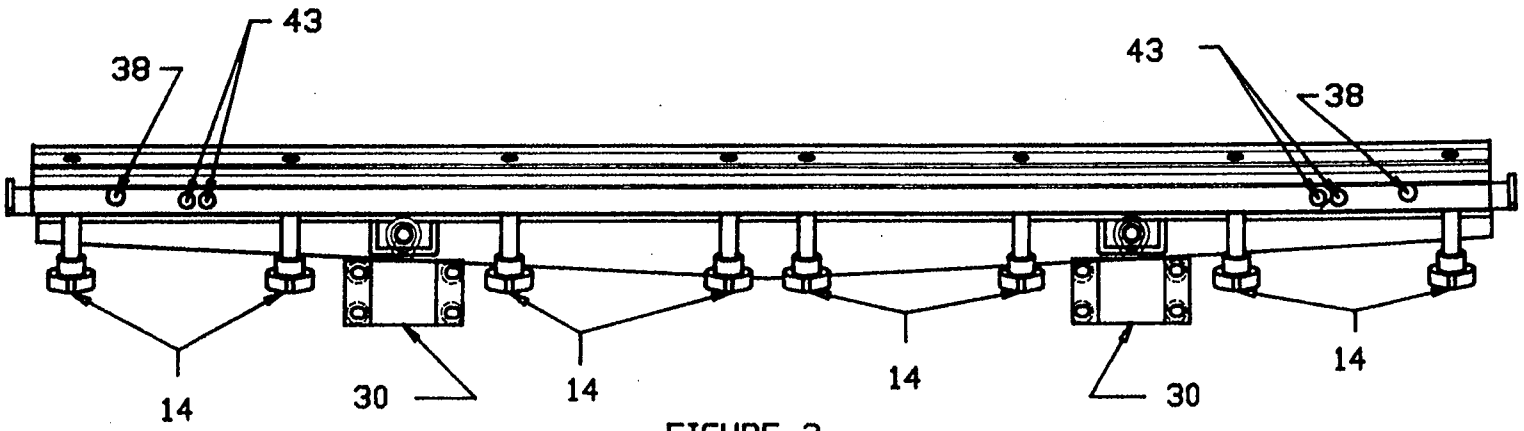
FIG. 3 shows a side elevational view of the fountain assembly.
Figure 4:
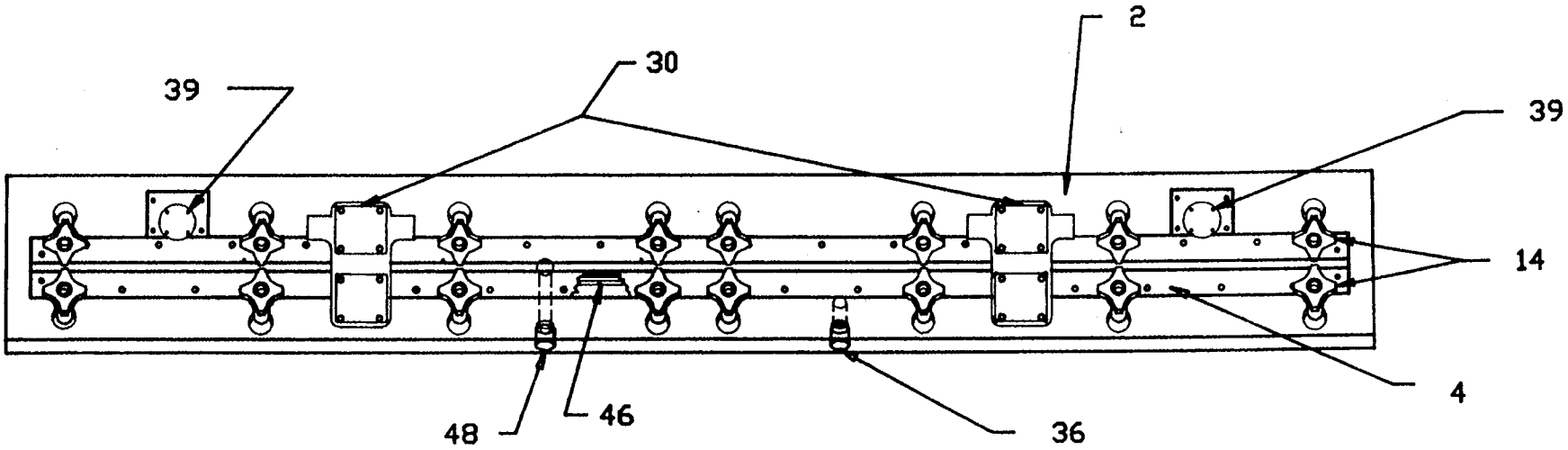
FIG. 4 shows a rear view of the fountain assembly which delineates the fountain frame and supporting brace.
Figure 7:
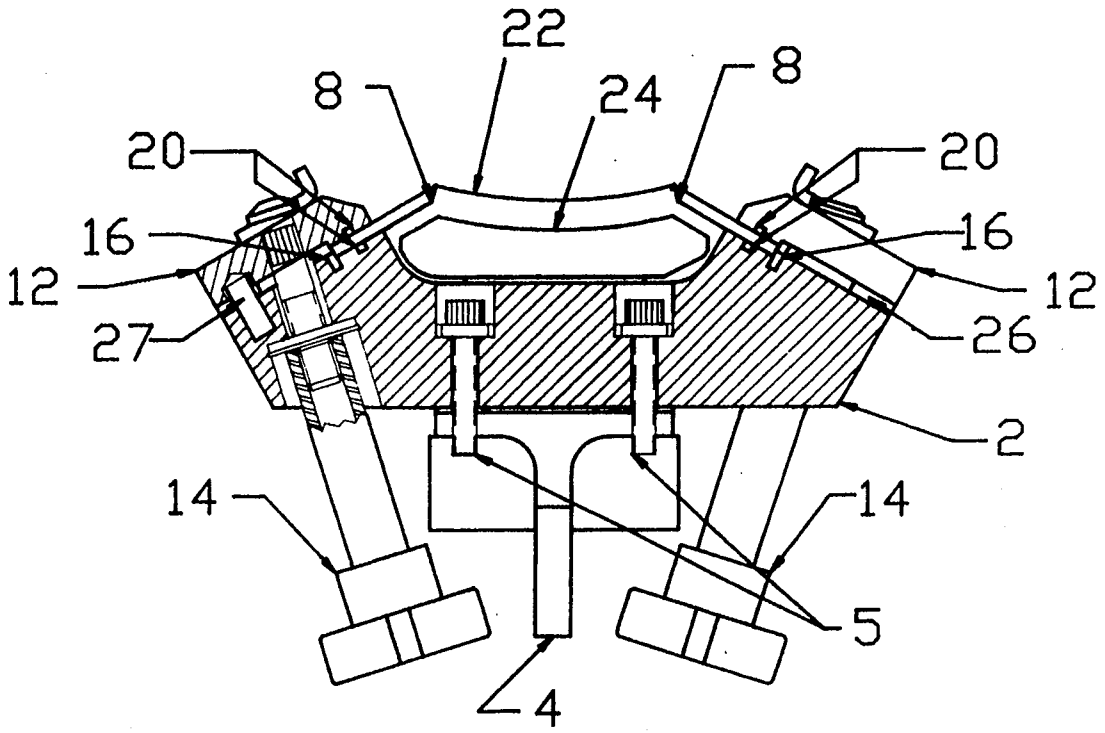
FIG. 7 is a cross sectional view of the fountain assembly of FIG. 2 along line IV—IV.
Figure 8:
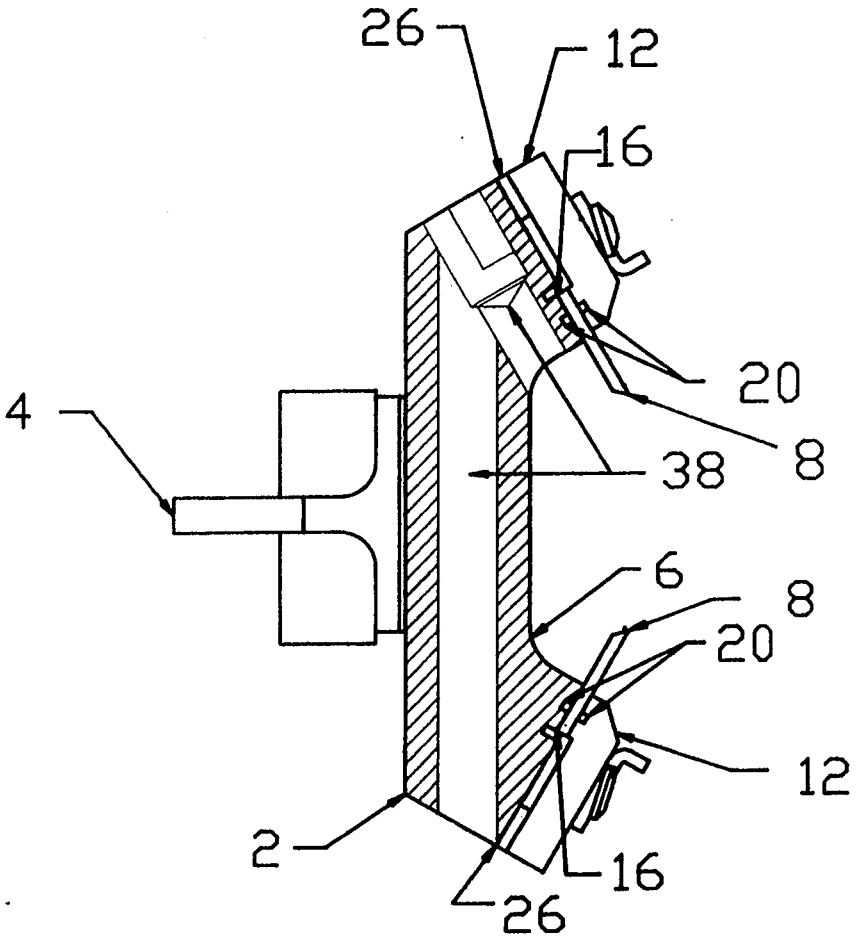
FIG. 8 is a cross sectional view of the fountain assembly of FIG. 2 along line III—III.
Figure 9:
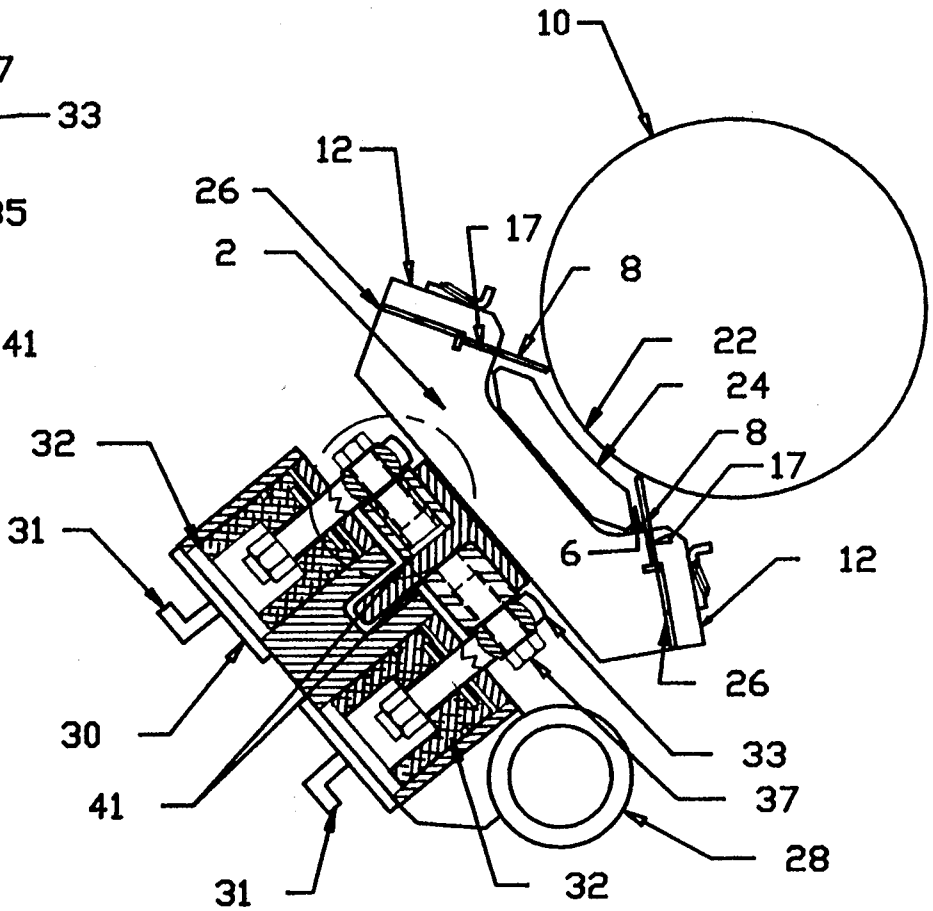
FIG. 9 is a side elevational view of the invention and shows a cross-sectional view of the air cylinders which are used in the fountain assembly.
Figure 10:
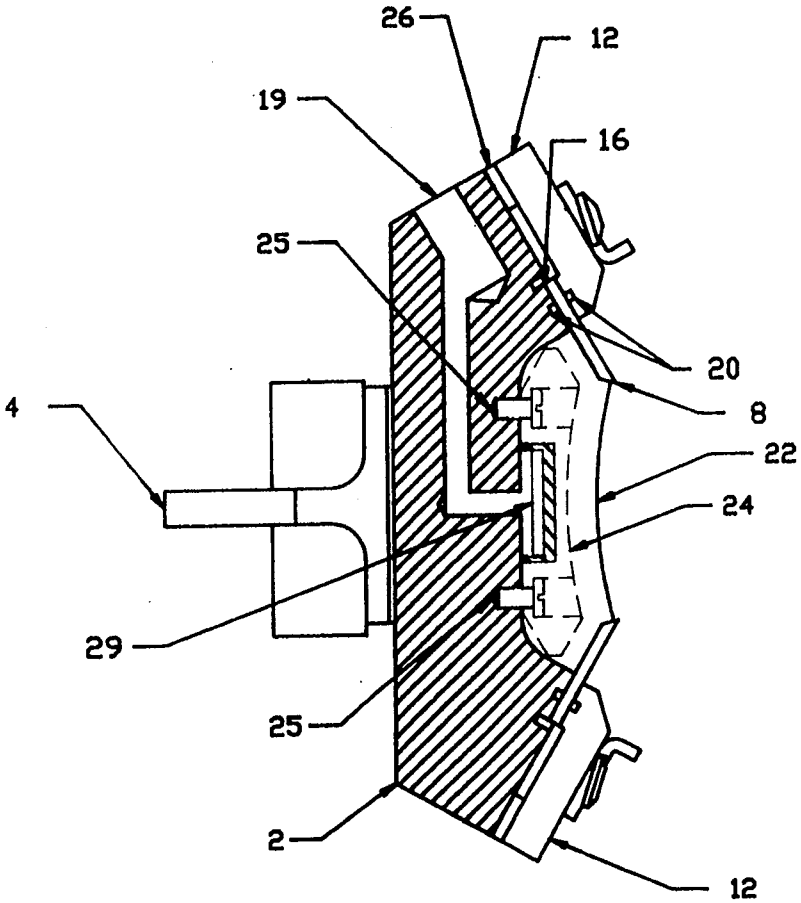
FIG. 10 is a side elevational view of the fountain assembly of the invention and shows the end seal lubrication system.
Figure 11:
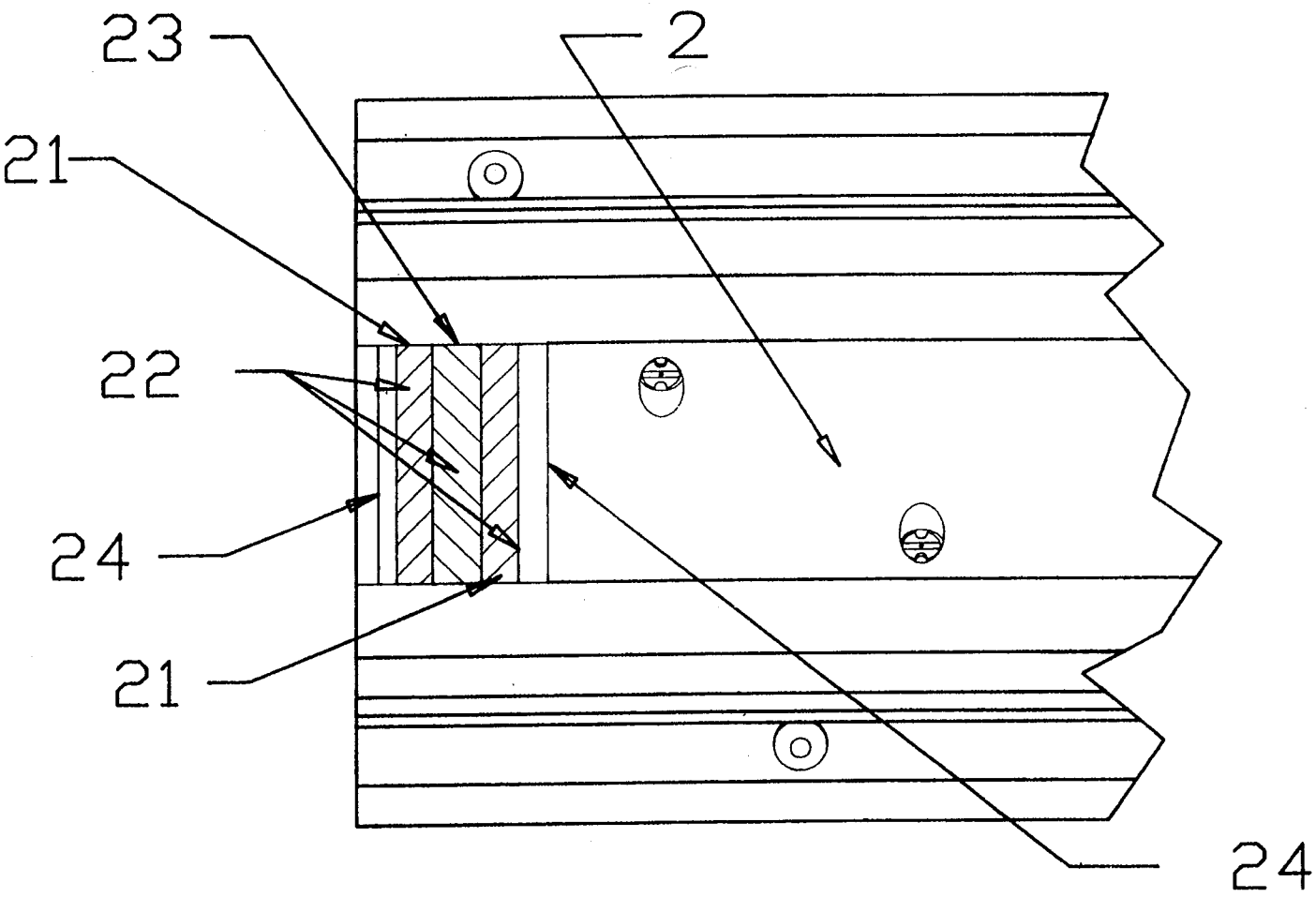
FIG. 11 is a top view of a composite radial surface seal in schematic form.

FIG. 1 shows a side view of the fountain assembly of the present invention and demonstrates its deployment with a rotating transfer roller, such as an anilox roller commonly used in flexographic printing. The assembly is shown to comprise an elongated fountain body or frame 2, which is composed of a light weight, substantially inert, resilient, polymeric plastic material such as high density polyethylene. By inert is meant a material which is resistant to corrosion by the components of the compositions to be applied to the transfer roller, such as flexographic inks, as well as washing compositions. A light weight frame has a tendency to deflect under load and so the rear side of the frame is supported along its entire length by a rigid reinforcing brace 4, preferably composed of steel, to provide added strength. As best seen in FIG. 7, the reinforcing brace is fixed to the plastic frame along its entire length by a series of bolts 5. The front side of the frame has a concave channel 6 formed along the length its entire length. Coating composition, such as a flexographic ink is supplied to the fountain assembly into this channel. On each side of the channel is a doctor blade 8. The doctor blades are configured to scrape against a rotating anilox roller 10 such that when an ink is fed into channel 6, it is applied to the surface of the roller 10 and excess ink is scraped off by the doctor blades 8 and returned to the channel. The doctor blades are fixed in place by means of clamp bars 12 which extend along the entire length of the fountain frame. The clamp bars are engaged along its entire length by a series of hand knobs 14. As best seen in FIGS. 1, 3 and 4, these knobs 14 are hand turnable threaded shanks which pass through and abut the fountain frame 2 and engage the clamping bars 12 such that when the knobs are tightened, they pull the clamp bars against the doctor blades and retain the blades in place. This is an important improvement over the prior art since this arrangement permits quick, tool-less doctor blade replacement. As best seen in FIG. 9, each doctor blade 8 is positioned along its entire length on a continuous step at location 17. This is an important improvement over the prior art since this arrangement permits quick, positive doctor blade positioning. At the base of each doctor blade is a sacrificial wear strip 16 which assists in the prevention of damage to the plastic frame body when metal doctor blades are used. The wear strip may consist of a resilient plastic material, such as a polyethylene strip which is positioned in a groove along the length of the frame at the doctor blade bases. A pair of seals 20, preferably made of an elastomer, are also positioned in grooves along the length of the frame abutting against each of the sides of the doctor blades. These seals prevent ink from seeping down behind the base of the doctor blades. As best shown in FIGS. 1 and 7, the ends of the ink channel 6 must be capped at its ends in order to prevent ink runoff from its sides. In this regard, abutting each end of the channel is an radial surface seal 22, which is held in place with an end seal holder 24 which is attached to the frame at each end of the channel. The end seal holders have a slotted section which maintain a fit between the seal and the holder thus securing the seal in place. The radial surface seals may be replaced simply by pulling them out of the holder without the use of tools. The end seal is radial in construction, that is, it has a rounded front edge which has substantially the same radius as the anilox roller so that it abuts the roller in use. This is best seen in FIG. 1. In one embodiment, this radial surface seal is a low cost, closed cell polyethylene foam material which is cut to fit the profile of the anilox roller and the contour of the fountain and doctor blades. In the preferred embodiment as shown in FIG. 11, the radial surface seal 22 is a three membered composite of a closed cell, non-absorbing foam elastomer 21, such as polyethylene foam on each side of a felt pad 23. Such a material provides an excellent seal between the roller, fountain chamber and doctor blades due to its resiliency. Referring now to FIG. 10, radial surface seal 22 is shown to be held in place with end seal holder 24. Each end seal holder is attached to frame 2 by means of screws 25. The radial surface seals are supplied with lubricating water or solvent composition which is supplied under pressure at continuous or regular pulsed intervals from a lubricant supply channel 19 which is an internal manifold within frame 2. The lubricant supply feeds lubrication reservoir 29 which in turn wicks through the radial surface seal. Leakage between the lubricant supply and the end seal is prevented by an appropriate gasket between the two. The lubricant is supplied to the composite radial surface seal with the result that friction between the seal and the transfer roller is substantially reduced. This provides an effective seal between the ink fountain chamber, doctor blades, and anilox roller and provides an inexpensive, replaceable seal with a much greater life expectancy that currently used seals. In the preferred embodiment, a cycled pulse of pressurized lubricant provides adequate lubrication. Such a lubricated system reduces the abrasive characteristics of inks on the end seals and reduces the wear characteristic of inks on the anilox roller at the end seal. The lubrication applied to the radial surface seals breaks down any ink build-up on the seal itself. This is important since dried flexographic inks are very abrasive. Such a lubricated radial surface seal is essentially unaffected by the rotation or speed of the roller. A pressurized lubricant cycle minimizes the amount of lubricant required to adequately lubricate the seal so that the desired seal life expectancy is attained. Reducing the amount of lubricant also minimizes any dilution effects that lubrication has on the viscosity of the inks. In addition, doctor blade replacement is eased since previous end seals require the operator to cut the doctor blade to its exact length for the seals to be effective. This design incorporates the doctor blade configuration into the seal and therefore close tolerances are not required.

Figure 5:
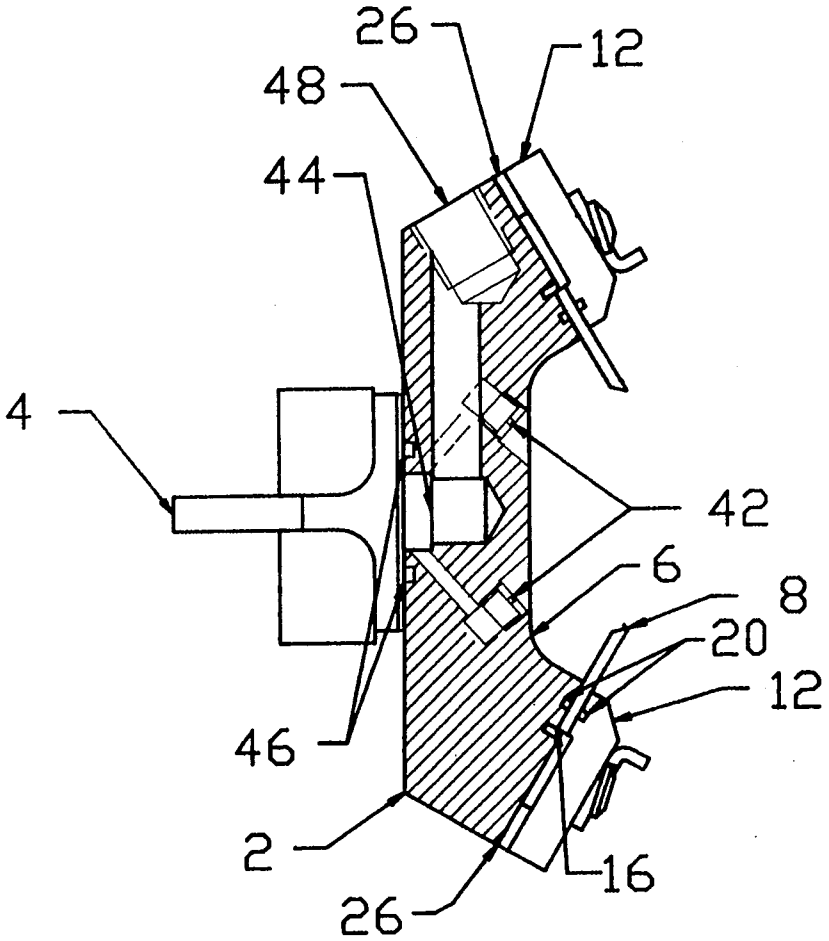
FIG. 5 is a cross sectional view of the fountain assembly of FIG. 2 along line II—II.

In the prior art, it has been a problem to use doctor blades of different thicknesses and separate doctor blade holders have been required. This invention essentially provides a universal doctor blade holder. As seen in FIG. 5, when one side of the clamp bars 12 press against the doctor blade ends, a gap is formed between the frame 2 and the other end of the clamp bars. In order to prevent the clamp bars from becoming cantilevered, a spacer strip 26 is provided between the frame and the clamp bars. As shown in FIG. 7, part 27 represents an locating pin for the spacer. The frame body and clamp bar, in conjunction with the spacer strips are able to accommodate different doctor blade thicknesses. A different doctor blade thickness can be used by simply changing the spacer strips in the assembly. Spacer strips may be composed of the same materials as are suitable for the doctor blades.

Figure 9A:
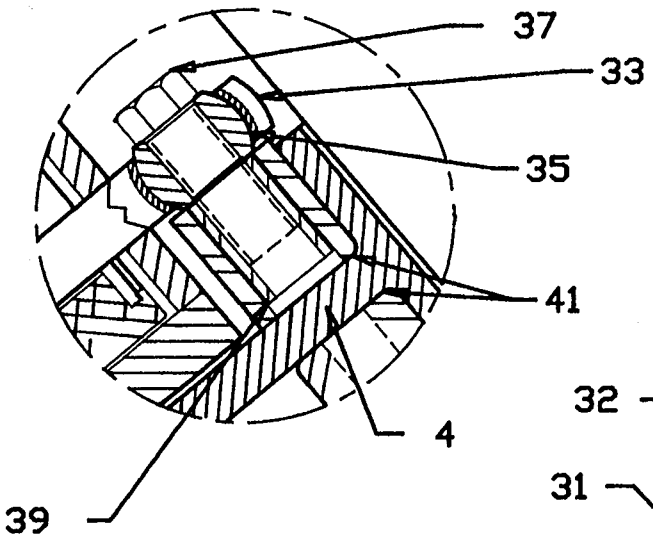
FIG. 9*a* shows an enlarged portion of the view in FIG. 9.

Referring to FIG. 1, the fountain assembly frame is supported by the overall coating or printing apparatus by means of a pivot shaft 28. Pivot shaft 28 extends parallel to the fountain frame along its length. The pivot shaft supports the weight of the fountain assembly and alternately swivels the assembly toward and away from the transfer roller. An improvement which the present invention provides over the prior art is that the fountain assembly is mounted on the pivot shaft by means of an arrangement of air cylinders positioned between the fountain and the pivot shaft. In the prior art, operators positioned a fountain assembly by swiveling it on a pivot shaft until the blades contact the anilox roller. This is disadvantageous because exact positioning of the blades is difficult and the blades tend to wear unevenly. This is particularly true with heavy weight, all metal fountain assemblies. The present invention mounts the fountain assembly to the pivot shaft by intermediate air cylinders 30. These cylinders independently position the blades in infinitely variable positions along the length of the frame. As best seen in FIG. 9 and 9*a*, air cylinders 30 comprise a piston arrangement 32 fed by a controlled air supply 31. The piston arrangement 32 presses or retracts the fountain assembly frame and hence engages the doctor blades with the anilox roller.

This provides for self compensating doctor blade tip wear and manufacturing tolerances, since pressure is variably applied to upper and lower doctor blades independently. The result is longer blade life. This system allows operators to repeat precise settings of the fountain. When activated, the air from the air supply 31 presses spherical bearing rod end 33 against the frame 2. The spherical bearing rod end 33 is attached to spherical bearing 35. Mounted through the spherical bearing 35 is a hex head bolt 37 which is coupled at its other end with sliding bushing 39 which slides in a bore within mounting blocks 41. When the air from the air supply 31 presses spherical bearing rod end 33, the spherical bearing rod end is free to move in a linear fashion toward or away the frame 2 within the degree of freedom permitted by the cylinder bore end caps. The amount of such movement can vary as bushing 39 slides within its bore. FIG. 9 shows across sectional view of one air cylinder, however, another is positioned adjacent to it and two more are set further down along the brace. In the preferred embodiment, four air cylinders are mounted between the pivot shaft and the brace to provide a fountain assembly which is essentially free floating against the transfer roller. The preferred arrangement of four air cylinders provide a four corner point pneumatic thrust loading arrangement. This arrangement is best seen in FIG. 4. Rod ends and spherical bearings useful within the context of this invention include those available commercially from the Heim Division of Incom International, Inc. of Fairfield Conn.

Air regulators on both the upper and lower sets of air cylinders provide the operator with the ability to accurately control doctor blade pressure. The brace 4 serves as a mounting surface for the air cylinders 30. By this arrangement of air cylinder mounting, the fountain is free floating against the transfer roller and is therefore substantially self adjusting.

Figure 2A:
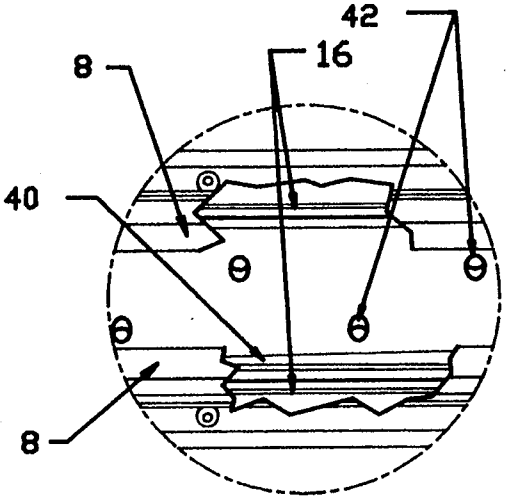
FIG. 2A shows an enlarged view of a section of the fountain assembly as in FIG. 2.
Figure 6:
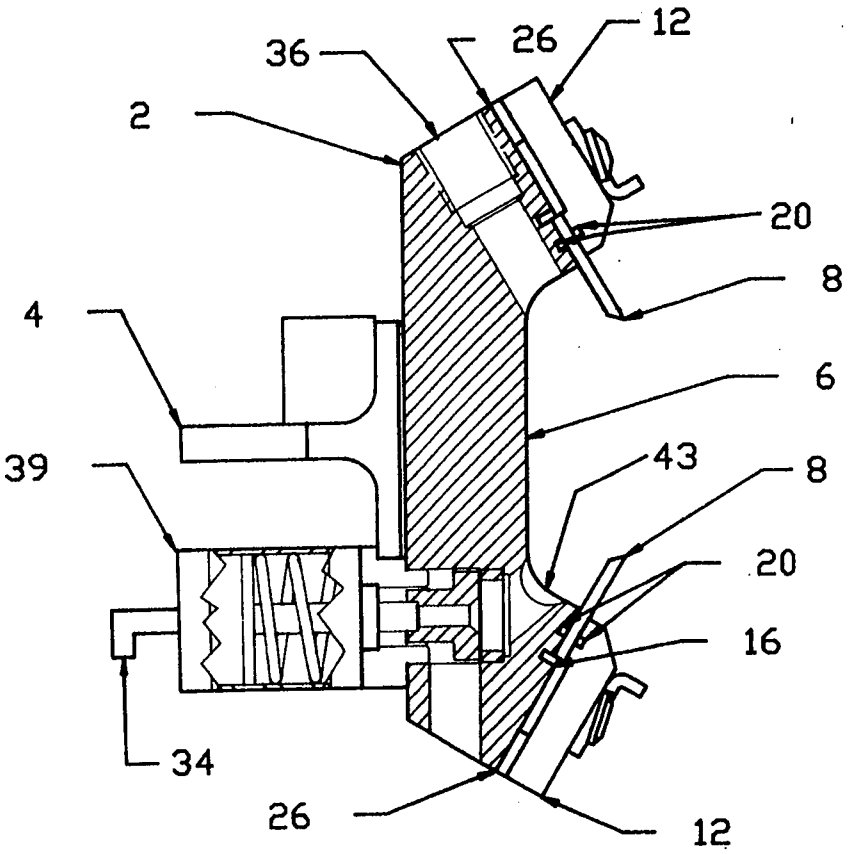
FIG. 6 is a cross sectional view of the fountain assembly of FIG. 2 along line I—I.

Referring to FIG. 6, ink or other coating composition is supplied to channel 6 of the fountain frame by means of internal ink supply ports 36. Excess ink or coating composition reverts back to a supply reservoir by overflow passageways 38 which are also internal to the frame. Ink can be drained from the fountain via passageways 43 by means of tapered ink drain leads 40 as seen in FIG. 2A. This prevents stagnant ink from remaining in the fountain chamber. This also results in an automatic ink return system which assures that the fountain channel is always filled with ink. If desired, a transparent window can be provided at the overflow port location so that the operator can confirm that the fountain is filled with ink. Pneumatically operated piston drain valves 39 as shown at the break-away section of FIG. 6, are positioned at each end of the fountain assembly to provide a quick and efficient means of controlling the return of ink from the fountain to storage reservoirs via ink returns and ink drains. Ink drain valves 39 are driven by an air supply provided through duct 34.

Figure 2:
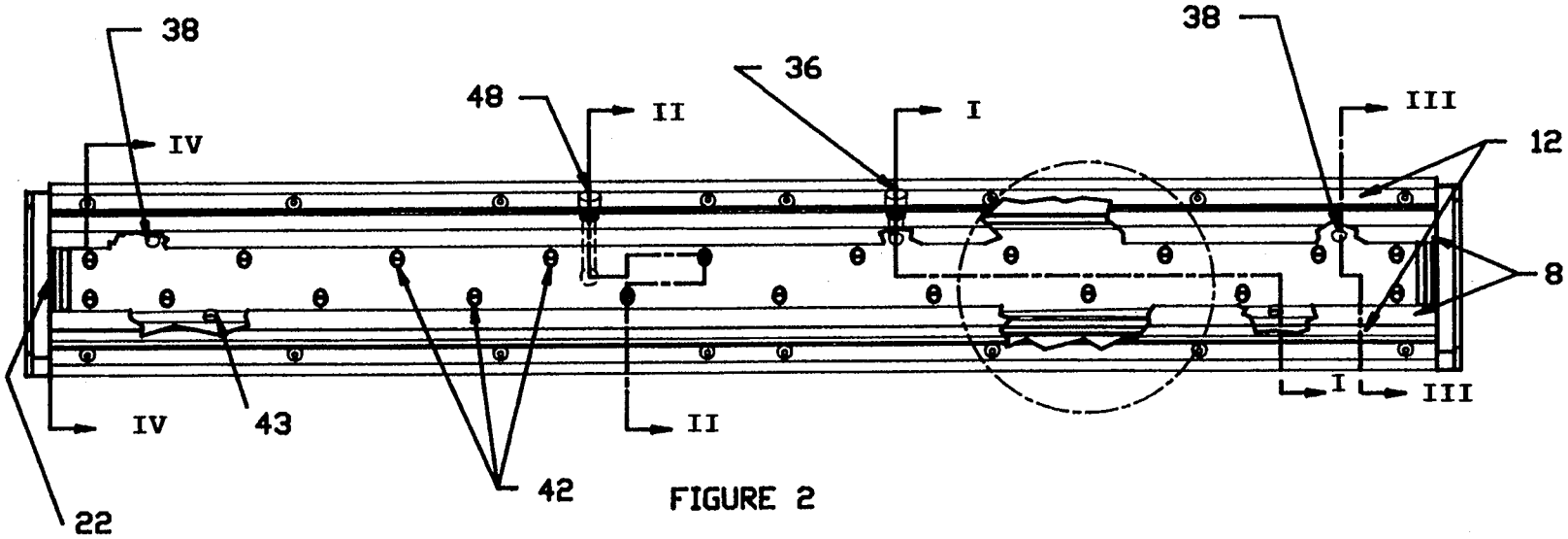
FIG. 2 shows a plan view of the fountain assembly according to the present invention.

An additional problem in the art of applying coating compositions to anilox rollers has been difficulty in fountain clean up. Clean up currently requires an excessive amount of operator time and cleaning compositions, and often requires disassembly of the fountain assembly from its mountings. The present invention improves on this requirement by providing means for quick, efficient and automatic fountain assembly wash-up. The fountain frame is provided with an internal wash-up system. As seen in FIG. 2, the base of channel 6 has a series of internal spray nozzles 42. By means of these nozzles, a supply of a washing solution is automatically fed to the fountain assembly. The nozzles 42 atomize and spray a metered amount of washing fluid under pressure over all parts of the assembly. It has been found to be most advantageous when the nozzles 42 are arranged in at least two rows along the entire length of the channel and spaced so that nozzles in one row are offset or staggered, rather than directly across from the nozzles in the next row as shown in FIG. 2. This causes a spray in a criss-cross pattern which effectively cleans the fountain assembly. It has been found that when nozzles are directly across from one another, their spray patterns interfere with one another and cleaning is not as effective. This method is particularly effective for cleaning the underside of the doctor blades. Heretofore it has been necessary to remove the blades from the fountain body to clean the underside of the blades. As best seen in FIG. 5, the internal nozzles 42 are fed with water or a cleaning solution by internal manifolds 44. In the preferred embodiment, manifold seals 46 are positioned at the locations where the external water supply engages the manifold. Cleaning solution is supplied to the manifold from an outside source under pressure through supply ports 48. By use of the present wash-up system, a sixty-five inch fountain can be automatically and effectively cleaned with approximately 1.5 gallons of water in about three minutes. An electronic analog or digital logic controlled wash-up cycle permits automatic control of washing cycles. This includes automatic actuation of drain valves in the fountain to return ink to storage reservoirs, automatic valving of waste water to storage tanks, and calculated, pressurized bursts of water at specific intervals to minimize the use of water throughout the cycle. At the end of the cycle, all valving can be returned to its original state. The tapered ink drains also serve to remove waste water during the wash-up cycle.

What is claimed is:

1. A fountain assembly for applying a fluid composition uniformly to the circumferential surface of a rotating transfer roller comprising:

(a) an elongated frame having a concave channel formed on one side of said frame along the length thereof, said frame comprising a substantially inert, resilient, light weight, polymeric plastic material; and (b) a rigid, reinforcing brace fixed along substantially the entire length of said frame on an outer side thereof opposite said channel; and (c) a pair of doctor blades removably attached by clamping means on opposite sides of said channel and extending the length of said channel, said blades being positionable to contact the circumferential surface of the transfer roller; and (d) a pair of radial surface seals secured to said frame at opposite ends of said channel, said radial surface seals being positioned to form a resilient bulkhead with the ends of said doctor blades, said radial surface seals having a complementary curved edge for forming a sealing engagement with the circumferential surface of the transfer roller; and (e) said radial surface seals, doctor blades and concave channel forming a closed chamber when positioned against the transfer roller; and (f) pivoting support means bearing said frame, said support means being capable of alternately swiveling said doctor blades toward and away from said transfer roller; and (g) means for providing a supply of a fluid composition into said channel.

2. The fountain assembly of claim 1 comprising means for providing a lubricating, liquid seal between said radial surface seals and said transfer roller at the circumferential surface of the transfer roller.

3. The fountain assembly of claim 2 wherein said means for establishing a lubricating, liquid seal comprises means for supplying a liquid under pressurized and at pulsed intervals to the radial surface seals.

4. The fountain assembly of claim 1 comprising air cylinder means mounted between said pivoting support means and said frame, said air cylinder means being capable of adjusting the position of said frame by thrusting the frame into and out of contact with the transfer roller.

5. The fountain assembly of claim 4 further comprising means for automatically positioning said air cylinders means to compensate for doctor blade wear.

6. The fountain assembly of claim 4 wherein said air cylinder means comprises a plurality of air cylinders mounted between said pivoting support means and said frame.

7. The fountain assembly of claim 6 wherein said air cylinders comprise a piston, which piston comprises a spherical bearing rod end slidable in a bore responsive to a flow of air impressed on said piston and permitting said spherical bearing rod end to press on and move away from said frame, said spherical bearing rod end extending through a spherical bearing, said spherical bearing being fixed to a bolt shaft which bolt shaft is fastened to a sliding bearing, said spherical bearing being mounted to permit pivoting of said bolt shaft and to permit said bolt shaft to slide in a direction substantially perpendicular to said spherical bearing rod end.

8. The fountain assembly of claim 1 wherein said means for providing a supply of a fluid composition into said channel further comprises fluid level adjusting means.

9. The fountain assembly of claim 8 wherein said fluid level adjusting means comprises at least one tapered drain lead having at least one overflow port capable of directing excess fluid from said channel to a reservoir.

10. The fountain assembly of claim 1 further comprising plurality of washing nozzles disposed along said channel capable of spraying a washing solution to said channel; internal manifold means within said frame for directing a washing fluid to said nozzles; and means for dispensing a controlled amount of a washing solution under pressure through said manifold and said nozzles.

11. The fountain assembly of claim 10 wherein said plurality of washing nozzles are disposed along said channel in a plurality of rows, said rows being spaced to provide a crossing spray pattern of washing solution from said nozzles to said channel.

12. The fountain assembly of claim 1 wherein said clamping means comprises a pair of clamp bars, one positioned along the length of each of said doctor blades, which clamp bars retain said doctor blades in said frame.

13. The fountain assembly of claim 12 wherein said clamping means comprises a plurality of manually turnable knobs which press each of said clamp bars and said doctor blades to said frame.

14. The fountain assembly of claim 1 wherein said clamping means secure said radial surface seals to said frame.

15. The fountain assembly of claim 1 further comprising a pair of wear strips, one positioned between each of said doctor blades and said frame along the entire length of said blades.

16. A fountain assembly for applying a fluid composition uniformly to the circumferential surface of a rotating transfer roller comprising:

(a) an elongated frame having a concave channel formed on one side of said frame along the length thereof, (b) a pair of doctor blades removably attached by clamping means on opposite sides of said channel and extending the length of said channel, said blades being positionable to contact the circumferential surface of the transfer roller; and (c) a pair of radial surface seals secured to said frame at opposite ends of said channel, said radial surface seals being positioned to form a resilient bulkhead with the ends of said doctor blades, said radial surface seals having a complementary curved edge for forming a sealing engagement with the circumferential surface of the transfer roller; and (d) said radial surface seals, doctor blades and concave channel forming a closed chamber when positioned against the transfer roller; and (e) pivoting support means bearing said frame, said support means being capable of alternately swiveling said frame toward and away from said transfer roller; and (f) upper and lower independent adjustment means mounted between said pivoting support means and said frame, said adjustment means being capable of adjusting the position of the frame and independently positioning the upper and lower doctor blades into and out of contact with the transfer roller; and (g) means for providing a supply of a fluid composition into said channel.

17. The fountain assembly of claim 16 further comprising means to automatically positioning said independent adjustment means to compensate for doctor blade wear.

18. The fountain assembly of claim 16 wherein said independent adjustment means comprises a plurality of air cylinders mounted between said pivoting support and said frame.

19. The fountain assembly of claim 18 wherein said air cylinders comprise a piston, which piston comprises a spherical bearing rod end slidable in a bore responsive to a flow of air impressed on said piston and permitting said spherical bearing rod end to press on and move away from said frame, said spherical bearing rod end extending through a spherical bearing, said spherical bearing being fixed to a bolt shaft which bolt shaft is fastened to a sliding bearing, said spherical bearing being mounted to permit pivoting of said bolt shaft and to permit said bolt shaft to slide in a direction substantially perpendicular to said spherical bearing rod end.

20. The fountain assembly of claim 16 wherein each of the upper and lower independent adjustment means comprises air cylinder means.

21. The fountain assembly of claim 16 wherein each of the upper and lower independent adjustment means comprises at least two air cylinders spaced along said elongated frame.

22. A fountain assembly for applying a fluid composition uniformly to the circumferential surface of a rotating transfer roller comprising:

(a) an elongated frame having a concave channel formed on one side of said frame along the length thereof, (b) a pair of doctor blades removably attached by clamping means on opposite sides of said channel and extending the length of said channel, said blades being positionable to contact the circumferential surface of the transfer roller; and (c) a pair of radial surface seals secured to said frame at opposite ends of said channel, said radial surface seals being positioned to form a resilient bulkhead with the ends of said doctor blades,. said radial surface seals having a complementary curved edge for forming a sealing engagement with the circumferential surface of the transfer roller; and (d) said radial surface seals, doctor blades and concave channel forming a closed chamber when positioned against the transfer roller; and (e) a plurality of washing nozzles disposed along said channel capable of spraying a washing solution to said channel; internal manifold means within said frame for directing a washing fluid to said nozzles; and means for dispensing a controlled amount of a washing solution under pressure through said manifold and said nozzles; and (f) pivoting support means bearing said fountain assembly, said support means being capable of alternately swiveling said frame toward and away from said transfer roller; and (g) means for providing a supply of a fluid composition into said channel.

23. The fountain assembly of claim 22 wherein said plurality of washing nozzles are disposed along said channel in a plurality of rows, said rows being spaced to provide a crossing spray pattern of washing solution from said nozzles to said channel.

24. A fountain assembly for applying a fluid composition uniformly to the circumferential surface of a rotating transfer roller comprising:

(a) an elongated frame having a concave channel formed on one side of said frame along the length thereof, (b) a pair of doctor blades removably attached by clamping means on opposite sides of said channel and extending the length of said channel, said blades being positionable to contact the circumferential surface of the transfer roller; and (c) a pair of radial surface seals secured to said frame one at each of the opposite ends of said channel, said radial surface seals being positioned to form a resilient bulkhead with the ends of said doctor blades, said radial surface seals having a complementary curved edge for forming a sealing engagement with the circumferential surface of the transfer roller and wherein said radial surface seals comprise a layer of an absorbent material and a layer of a closed cell, non-absorbing foam polymer attached on each opposite side of said absorbent material; and (d) said radial surface seals, doctor blades and concave channel forming a closed chamber when positioned against the transfer roller; and (e) pivoting support means bearing said frame, said support means being capable of alternately swiveling said frame toward and away from said transfer roller; and (f) means for providing a supply of a fluid composition into said channel; and (g) lubrication supply means comprising a manifold internal to the frame for directing lubricating fluid to said radial surface seals; and means for supplying a lubricating fluid to said manifold in an amount sufficient to maintain said radial surface seals moist with lubricating fluid.

25. The fountain assembly of claim 24 wherein said absorbent material comprises felt and the foam polymer comprises polyethylene.

* * * * *